US007647760B2

(12) United States Patent
Griesshammer et al.

(10) Patent No.: US 7,647,760 B2
(45) Date of Patent: Jan. 19, 2010

(54) DRAWING FRAME-ROVING FRAME COMBINATION FOR THE PRODUCTION OF ROVE BY MEANS OF A PNEUMATIC SPINNING PROCESS

(75) Inventors: Christian Griesshammer, Winterthur (CH); Herbert Stalder, Kollbrunn (CH)

(73) Assignee: Maschinenfabrik Rieter AG, Winterthur (CH)

( * ) Notice: Subject to any disclaimer, the term of this patent is extended or adjusted under 35 U.S.C. 154(b) by 422 days.

(21) Appl. No.: 10/571,413

(22) PCT Filed: Jul. 6, 2004

(86) PCT No.: PCT/CH2004/000424

§ 371 (c)(1),
(2), (4) Date: Jan. 16, 2007

(87) PCT Pub. No.: WO2005/026420

PCT Pub. Date: Mar. 24, 2005

(65) Prior Publication Data

US 2007/0144136 A1 Jun. 28, 2007

(30) Foreign Application Priority Data

Sep. 12, 2003 (CH) ..... 1579/03
Jan. 23, 2004 (CH) ..... 0097/04

(51) Int. Cl.
*D02G 3/02* (2006.01)

(52) U.S. Cl. ..... 57/317; 57/209; 57/350

(58) Field of Classification Search ..... 57/209, 57/317, 350, 403
See application file for complete search history.

(56) References Cited

U.S. PATENT DOCUMENTS

| | | | | |
|---|---|---|---|---|
| 3,722,198 | A * | 3/1973 | Gotzfried | 57/403 |
| 4,858,420 | A | 8/1989 | Stahlecker et al. | |
| 2003/0056488 | A1 * | 3/2003 | Raasch | 57/400 |
| 2007/0193245 | A1 * | 8/2007 | Griesshammer et al. | 57/209 |

FOREIGN PATENT DOCUMENTS

| | | |
|---|---|---|
| CH | 617465 | 5/1977 |
| DE | 3237989 | 7/1983 |
| EP | 0375242 | 6/1990 |
| EP | 1329541 | 7/2003 |
| GB | 19094508 | 0/1910 |

* cited by examiner

*Primary Examiner*—Shaun R Hurley
(74) *Attorney, Agent, or Firm*—Dority & Manning, P.A.

(57) ABSTRACT

A drawing frame-slubbing machine combination for manufacturing a roving yarn from a fiber assembly is disclosed. The drawing frame-slubbing machine combination includes a drawing frame for doubling and stretching a fiber assembly into a drafter sliver and a slubbing machine with a twist application component configured to apply a true twist to the drafter sliver by one or more air flows.

20 Claims, 9 Drawing Sheets

I-I

DRAWING FRAME-ROVING FRAME COMBINATION FOR THE PRODUCTION OF ROVE BY MEANS OF A PNEUMATIC SPINNING PROCESS

FIELD OF THE INVENTION

The present invention relates to a drawing frame-slubbing machine combination for the doubling and drafting of several fiber assemblies to form a drafter sliver and for the subsequent manufacture of a roving yarn from the drafter sliver. The present invention also relates to a method for the manufacture of a roving yarn.

BACKGROUND OF THE INVENTION

A combined device of this type is unknown in the textile technology. The drawing frame as a textile machine for the doubling and drafting of several fiber assemblies to form one sliver is known. Slubbing machines for the manufacture of what are known as roving yarns from one or more slivers are indeed also known. However, stubbing machines with twist application elements according to the present invention are unknown. The stubbing machines according to the present invention include, for example, the speed frame or roving frame. The roving yarn serves as the supply material for the actual spinning process. For example, the roving yarn may serve as the supply material for the spinning of the fibers to make a fiber yarn on a ring-spinning machine.

The fiber assemblies coming from the preliminary system (carding room) are, according to the prior art, first doubled with the aid of drawing frames and at the same time stretched or drafted, and then deposited in cans. The sliver which results from this process is then supplied to the stubbing machines (speed frames) for further processing. The sliver is first subjected to further stretching or drafting in an individual drafting assembly. Second, the sliver is slightly twisted by the application of twist. The original fiber assembly is then wound up as roving yarn on a roving yarn bobbin. The roving yarn, also referred to as fiber stubbing, flyer stubbing, flyer yarn or generally slubbing, usually serves as supply material for ring-spinning machines.

The slubbing machine, as mentioned, usually exhibits its own drafting device. In most cases, this drafting device is a double apron draft system. After being drawn through the drafting device of the slubbing machine, the fiber assembly undergoes a slight twist, referred to as a protective twist, in order for the slubbing to exhibit sufficient strength to be wound on a bobbin without disintegrating. The twist must only be of sufficient strength for the roving yarn to be held together for the winding and later unwinding and for the transport of the bobbins. In particular, the twist must be sufficiently strong to prevent false drafts (thin places in the roving yarn) from occurring. The twist must be easy to release and the roving yarn must be capable of being drawn for the subsequent spinning process, for example in a ring-spinning machine, to be put into effect.

A speed frame is often used as a slubbing machine to manufacture the correspondingly-named flyer stubbing. The speed frame is equipped with a drafting device and a spindle for winding up the flyer stubbing onto a cylinder bobbin by means of a flyer which supports the slubbing against the centrifugal force incurred by the bobbin revolutions. The speed frame is an expensive machine due to the complicated winding mechanism. In addition, the usual output from a speed frame is about 20-25 meters of roving yarn per minute. This low production cannot be increased with regard to the winding system with flyers because a higher speed is limited by the centrifugal force that the flyers and roving yarn bobbin must withstand.

Attempts have been made to circumvent the use of the stubbing machine by a process called direct spinning or sliver-to-yarn spinning. In this process, the sliver is delivered directly as supply material for the ring-spinning machine. However, the high draft produced by sliver direct spinning only achieves the result to a restricted degree compared to that obtained with the supply of a flyer slubbing on the ring spinning machine. This is particularly true if fine yarns with Nm 50 and finer are being spun. In addition, the supply of drafting cans with fiber slivers to ring-spinning machines is elaborate and complicated.

One possibility for replacing a speed frame is disclosed in the printed specification EP 375 242 A2. This publication describes a machine for the manufacture of a roving yarn from a fiber assembly having a twist application means with a rotating rotor. The rotor exhibits a continuous longitudinal hole on its axis of rotation through which the fiber assembly to be twisted is guided. The rotor has at a specific height several holes arranged rotationally symmetrically in the radial direction. These radial holes connect the longitudinal hole with the outer surface of the rotor. This outer surface of the rotor is subjected to a vacuum or a strong under-pressure. As the fiber assembly is drawn through the longitudinal hole, individual free fiber ends are sucked off the surface of the fiber assembly into the radial holes. In operation, the rotor rotates while the fiber assembly is drawn through the longitudinal hole. In this manner, the fiber ends located in the radial holes are wound around the moving fiber assembly. As a result, a true twist is applied to the fiber assembly or its individual fibers. The device according to the above mentioned publication is relatively expensive in manufacture and operation due to the mechanical elements (rotating rotor) and the vacuum technology.

DE 32 37 989 C2 teaches the principle of drawing a fiber stubbing or drawing sliver in a drafting device and then applying a twist to the drawn fiber assembly. The application of the twist is effected by air jets in two sequential twist chambers. The application of the twist in the first pneumatic twist chamber is performed in a direction counter to the application of twist in the second pneumatic twist chamber. For example, the first twist application causes, a left-hand rotation and the following twist application in the second twist chamber causes a right-hand rotation. A yarn produced in this manner is produced in accordance with what is known as a false twist spinning process.

Patent Specification CH 617 465 teaches a false twist nozzle used for the manufacture of a staple fiber yarn, which likewise utilizes a false twist spinning process. During the production of a yarn, i.e. during the spinning process, the individual fibers are spun or twisted with one another sufficiently strongly for the twisting to be quasi-irreversible, and the yarn produced cannot be drawn any further. The strengthening achieved by the twisting is necessary because it is the only way it will obtain the necessary high tensile strength. The consequence of this, however, is that the devices and spinning processes referred to are not suitable for forming a roving yarn. A roving yarn exhibits only what is referred to as a protective twist. A protective twist must not impede the further spinning processes on the following machines, for example drafting at the ring-spinning machines. In other words, roving yarn must remain capable of being drawn or drafted. The devices described in the two publications above are therefore only suitable for the manufacture of yarns and are not suitable for the manufacture of a roving yarn that remains capable of being drafted.

An object of the present invention is to provide a drawing frame-slubbing machine combination and a method for the manufacture of a roving yarn that avoids the disadvantages referred to above and exhibits the characteristics of conventional flyer slubbings or roving yarns.

SUMMARY OF THE INVENTION

A summary of exemplary embodiments of the present invention will be set forth here. Using the description provided herein, one skilled in the art will understand that additional exemplary embodiments are within the scope of the present invention.

The combination of the drawing frame with a slubbing machine having twist application elements according to the exemplary embodiments described herein shortens the process for manufacturing a roving yarn from a fiber assembly and therefore allows for a higher production capacity.

In one exemplary embodiment, the present invention provides a drawing frame-slubbing machine combination for the manufacture of a roving yarn from a fiber assembly. The drawing frame-slubbing machine combination includes a drawing frame configured to produce a drafter sliver from said fiber assembly. The drawing frame-slubbing machine also includes at least one spinning position. The spinning position has a twist application component for twisting the drafter sliver to form a roving yarn. For this purpose, the twist application component includes a swirl chamber. In alternate embodiments of the present invention, the swirl chamber may include a roving yarn formation element. The roving yarn formation element may be a spindle. In the swirl chamber of the twist application component, a true twist (rotation) is at least partially applied to the drafter sliver by an air flow. The twist may be a protective twist, the result of which the roving yarn remains capable of being drafted or drawn.

In another exemplary embodiment, the drawing frame-slubbing machine combination may include a second twist application component. This second twist application component includes a swirl chamber without a roving yarn formation element. This swirl chamber includes means which allow for an air flow in the swirl chamber. This air flow applies a true twist (rotation) at least in part to the drafter sliver. This further embodiment of a twist application component may also exhibit several swirl chambers with correspondingly several means for the formation of an air flow (see FIG. 3B or 3C).

In yet another exemplary embodiment, the twist application component has one or more twist stops. These twist stops can be designed, for example, as edges, pins, as toroidal surfaces, as cones, or as several deflection surfaces. The twist application component may exhibit a combination of the twist stops just referred to, such as a toroidal surface with a pin, or a cone with a pin, or an edge with a pin, or a toroidal surface with a pin.

In still another exemplary embodiment, the twist application component includes several nozzles for the production of air jets. The nozzles are arranged in such a way that the air jets emerging from the nozzles create a single, unidirectional air flow. This does not necessarily apply in situations in which several swirl chambers are present. If several swirl chambers are present, the air flows can have opposite directions of rotation. Preferably, the nozzle holes are arranged rotationally symmetrically inside a swirl chamber around the axis of the swirl chamber (the entry angles of the nozzle holes are therefore the same). If several swirl chambers are present, the nozzles can preferably be arranged in such a way that the nozzles of an individual swirl chamber are indeed arranged rotationally symmetrically, but each swirl chamber exhibits a different entry angle for the individual nozzles. The air jets emerging in the individual swirl chambers can therefore exhibit not only different directions of rotation, in the sense of a left or right rotation, but may also have different "rise angles." A rotationally-symmetrical arrangement of the nozzles is shown in FIG. 2. A rotationally-symmetrical offset arrangement of the nozzles can be seen in FIG. 3B and FIG. 3C.

In still a further exemplary embodiment, the twist application component includes a funnel or an aerodynamic or mechanical condenser that has the function of restricting the width of the drafter sliver before it enters the twist application component.

In still a further exemplary embodiment, the distance between the intake aperture of the roving yarn formation element and the last nip line is not greater than the longest fiber length of the drafter sliver or greater than the mean staple fiber length of the drafter sliver.

In still a further exemplary embodiment, the distance interval between the inlet of the twist application component and the last nip line is not greater than the longest fiber length in the drafter sliver.

In yet another exemplary embodiment, the slubbing machine includes a winding device downstream from the twist application component. The winding device winds up the roving yarn emerging from the twist application component. The winding device may be a cross-winder, a precision cross-winder, a random cross-winder, a step precision cross-winder, or a parallel winder.

In yet another exemplary embodiment, the twist application component only applies a protective twist to the fiber assembly so that the roving yarn remains capable of being drafted.

Another exemplary embodiment of the present invention includes a method for the manufacture of a roving yarn from a fiber assembly. Under this method, the fiber assembly is first doubled and stretched in a drawing frame to produce a drafter sliver. The drafter sliver is then stretched and at least partially subjected to a true twist by an air flow.

In a variation of this exemplary embodiment, several nozzles may be present for the production of air flow. The nozzles are preferably arranged in such a way that the emerging air jets produce a single, unidirectional air flow. For this purpose, the nozzles are preferably arranged rotationally symmetrically around one axis in a swirl chamber (see FIG. 2) or rotationally symmetrically offset around an axis (see FIGS. 3B and 3C).

The present invention is not restricted to the embodiments described herein. Rather, the variations of the exemplary embodiments discussed above are intended to be incentives for the person of ordinary skill in the art to implement the idea of the invention in as favorable a manner as possible. Accordingly, further advantageous embodiments and combinations can be easily derived from the embodiments described and shown herein. The applicants therefore expressly reserve the right to make provision for such further advantageous embodiments and combinations.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE DRAWINGS

Objects and advantages of the invention will be set forth in the following description, or may be apparent from the description, or may be learned through practice of the invention. Attention should expressly be drawn to the fact, however, that the invention and the idea of the invention are not restricted to the embodiments shown in the examples.

Figure 1:
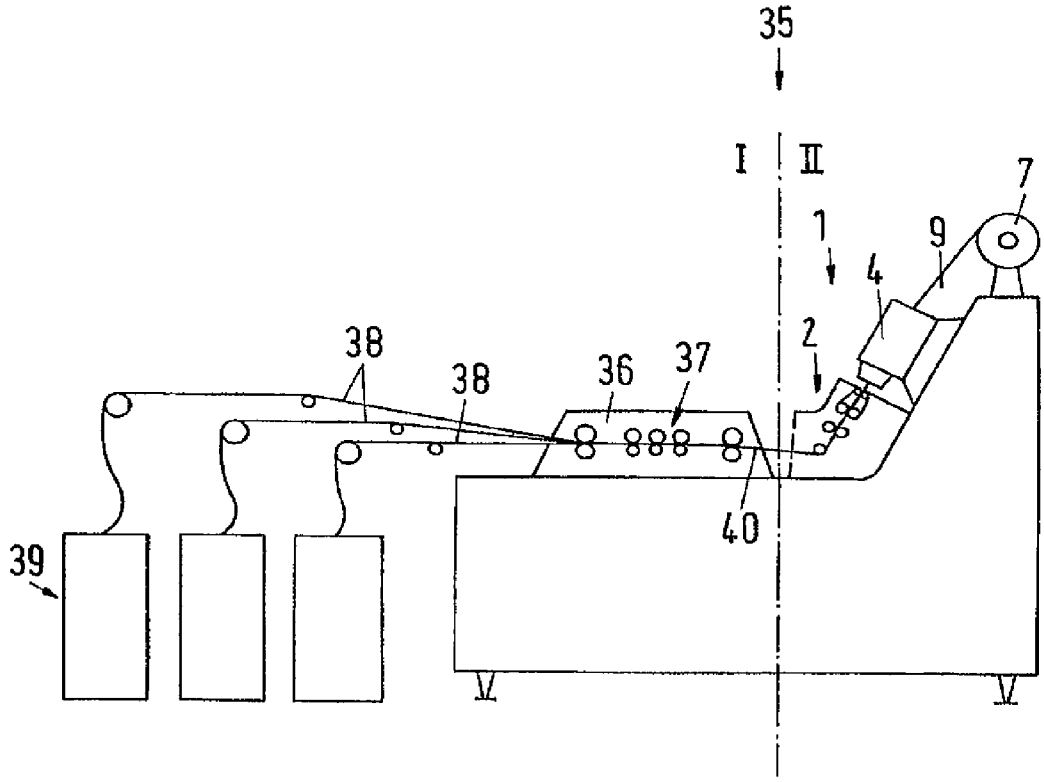
FIG. 1 shows a drawing frame-slubbing machine combination according to an exemplary embodiment of the present invention.

FIG. 1 shows a drawing frame-slubbing machine combination 35 according to an exemplary embodiment of the present invention. This machine can be divided schematically into two sections, section I and section II. Section I contains the drafting device 36 with a drafting unit 37. The drafting unit 37 is preferably regulated. The fiber assemblies 38, which are taken from several cans 39, are doubled before entering the drafting device and are stretched in the drafting unit 37. The resulting drafter sliver 3 is then conducted directly to the section II of the drawing frame-slubbing machine combination according to an exemplary embodiment of the present invention. In sector II and at the respective spinning positions 1, a roving yarn 9 is manufactured from the drafter sliver 3. For this purpose, the drafter sliver 3 runs through a drafting device 2 and a twist application component 4 arranged downstream of the drafting device 2. The roving yarn 9 is then wound up by a winding device 7. The function of the twist application component 4 is described below.

Figure 1A:
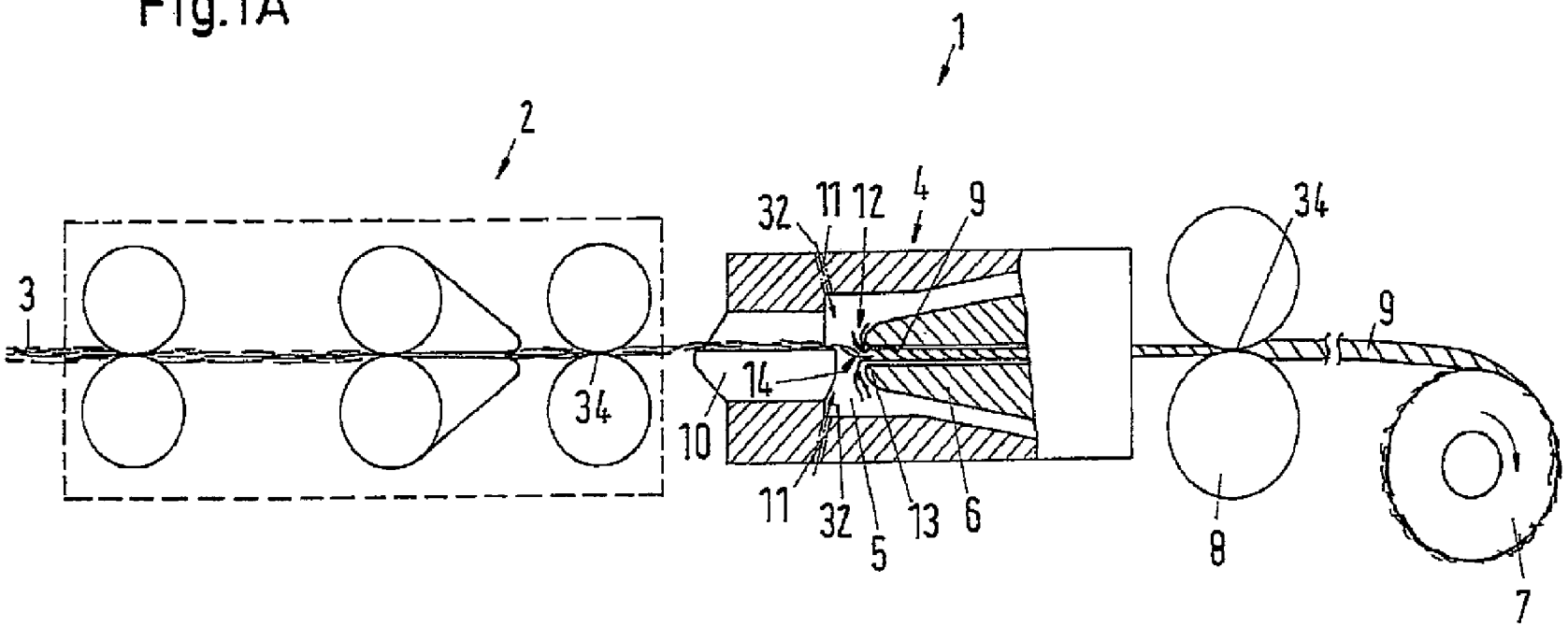
FIG. 1A shows in diagrammatic form a possible spinning position 1 of a drawing frame-slubbing machine combination (whole machine not shown) according to an exemplary embodiment of the present invention.

FIG. 1A shows in diagrammatic form a possible spinning position 1 of a drawing frame-slubbing machine combination (entire machine not shown) according to an exemplary embodiment of the present invention. FIG. 1A shows only one of several possible embodiments for the twist application component 4. The drawing frame-slubbing machine combination according to the present invention may also be equipped with twist application component that operates according to a different air-spinning process.

The exemplary embodiment of the spinning position 1 shown in FIG. 1A exhibits a drafting device 2 which is supplied with a drafter sliver 3. The drafter sliver 3 may be a doubled drafter sliver. The drafter sliver 3 passes from the drafting device 2 into the twist application component 4. In the twist application component 4, the drafter sliver 3 is twisted to form a roving yarn 9. In particular, the drafter sliver is at least partially subjected to a true twist.

FIG. 1A also shows a pair of delivery rollers 8 with a nip line 34 and a winding device/take-up motion 7 for the roving yarn 9. Using the teachings disclosed herein, one of ordinary skill in the art will understand the present invention does not require a drafting device 2 or a pair of delivery rollers 8 as represented in FIG. 1A.

The twist application component 4 shown in FIG. 1A operates according to the vortex process, a special air-spinning method. The vortex air-spinning method is a known yarn spinning process. As described, devices for the forming of yarn are unsuitable for the manufacture of a draftable roving yarn. Surprisingly and unexpectedly, experiments with suitably modified air-spinning devices have revealed that certain air-spinning processes are suitable for the manufacture of roving yarns. To achieve this, however, the dimensions and flow circumstances of conventional yarn air-spinning devices must be adapted. In particular, the twist application component need only apply a protective twist to the drafter sliver in order for the stubbing or roving yarn to remain capable of being drafted. Conventional air-spinning devices rotate the drafter sliver in such a way that the yarn or thread is strongly twisted in a manner causing the twist to be irreversible and causing the yarn or thread to be no longer capable of being drafted. By providing correspondingly larger dimensions for the air-spinning devices, as well as an adjustment of the flow characteristics, and in particular by suitably high delivery speeds, it is possible to manufacture roving yarns or slubbings capable of being drafted in air spinning devices. The most suitable characteristics are best determined experimentally.

According to initial experiments, air-spinning devices for roving yarns exhibit preferably one or more of the following properties:

- The diameter of the twist or swirl chamber amounts to at least 5 mm;
- The delivery speed of the drafter sliver amounts to at least 200 m/min;
- The pressure of the air flow, before it flows out through the nozzle holes or nozzles into the swirl chamber amounts to a maximum of approximately 5 bar;

The air-spinning devices should administer a deep winding rotation to the roving or stubbing. The winding rotation or coefficient of rotation $alpha_m$ is less than 70.

The mode of operation for exemplary embodiments of the present invention is similar to that of conventional air-spinning processes for the formation of yarn. For this reason, the air-spinning processes are not discussed here in any great detail. By contrast with conventional air-spinning devices, the devices and methods according to exemplary embodiments of the present invention only apply a protective twist to the drafter sliver and the roving yarn. This protective twist is of such a nature that the roving yarn remains capable of being drawn for the further processing. To form the roving yarn, the drafter sliver is subjected at least in part to a true twist by an air flow. This true twist or rotation is, as mentioned, only a protective twist. The roving or slubbing manufactured according to the present invention therefore has the same properties as a stubbing manufactured with a conventional speed frame.

One exemplary embodiment of a twist application component 4 according to the present invention is shown in FIG. 1A. The twist application component 4 operates according to what is known as the vortex air-spinning process. The device 4 includes a fiber guide element 10 with which the drafter sliver 3 is delivered into the swirl chamber 5 of the twist application component 4. In the swirl chamber 5 a fluid device, not represented in greater detail, creates an air flow 32 or a swirl flow, by means of one or more nozzles 11. The resulting swirl flow inside the swirl chamber 5 causes the individual free fiber ends 12 on the surface of the drafter sliver 3 to lie around the inlet aperture 13 of the roving yarn formation element 6. The free fiber ends 12 are taken up by the rotating swirl flow in the swirl chamber and are rotated around the core 14 of the drafter sliver. As a result, the drafter sliver 3 in the swirl chamber 5 is subjected at least partially to a true twist by an air flow 32. Specifically, this air flow causes at least some of the individual fibers of the drafter sliver to be subjected to a true twist around a core of fibers. The roving yarn 9 which is formed at the inlet aperture 13 is drawn off by a pair of delivery rollers 8 and wound up onto a winding device 7. To do this, the roving formation element 6 exhibits a hole (see FIG. 1A). The winding device 7 in FIG. 1A is represented in diagrammatic form only. Using the teachings disclosed herein, those of ordinary skill in the art will appreciate that the scope of the present invention is not limited to the particular winding device 7 depicted in FIG. 1A. For example, the winding device can be a cross winder, a precision cross-winder, a random cross-winder, a stepped cross-winder, or a parallel winder.

Figure 2:
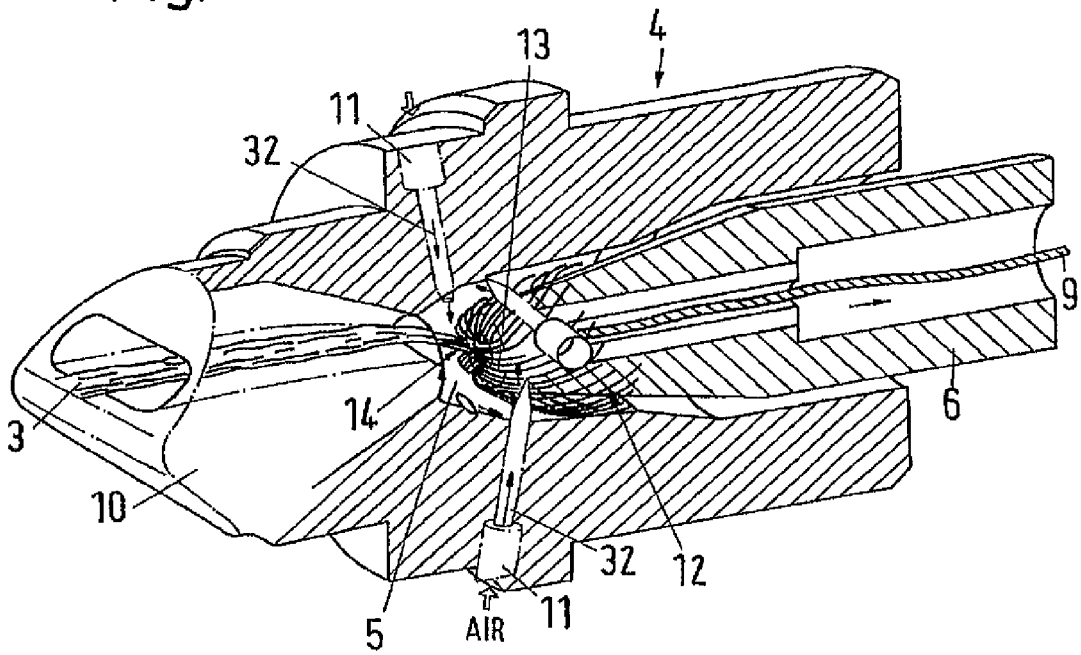
FIG. 2 shows a sectional view of the twist application component shown in FIG. 1.

FIG. 2 shows the twist application component 4 from FIG. 1A in another view. FIG. 2 illustrates how the drafter sliver 3 is guided by the fiber guide element 10 into the swirl chamber 5. In the swirl chamber 5, a swirl air flow created by the nozzles 11 takes up the free fiber ends 12 of the drafter sliver 3 and lays them around the inlet aperture 13 of the roving yarn formation element 6. The free fiber ends 12 lying around the inlet aperture 13 form a "sun" rotating around the core 14 of the drafter sliver. The free fiber ends 12 accordingly rotate about the core 14 of the drafter sliver. As a result, the drafter sliver 3 receives at least in part a true twist in the swirl chamber 5. The roving yarn 9 which is formed at the inlet aperture 13 is drawn through (see arrow) by the roving yarn formation element 6. The roving yarn formation element in the exemplary embodiment depicted in FIG. 2 is a spindle.

Figure 3B:
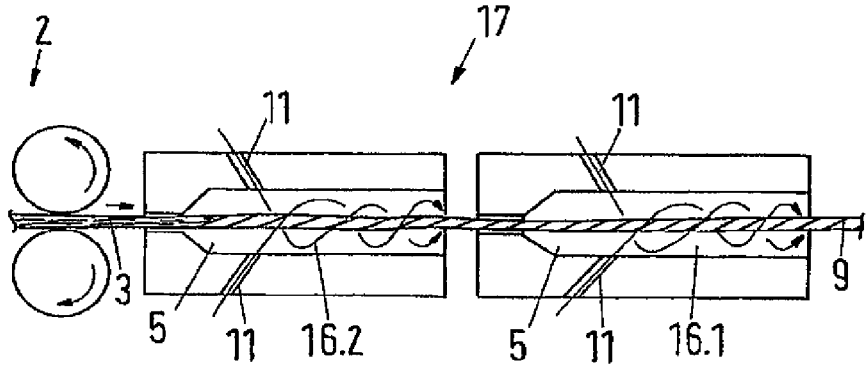
FIG. 3B shows a variant of the twist application component.
Figure 3:
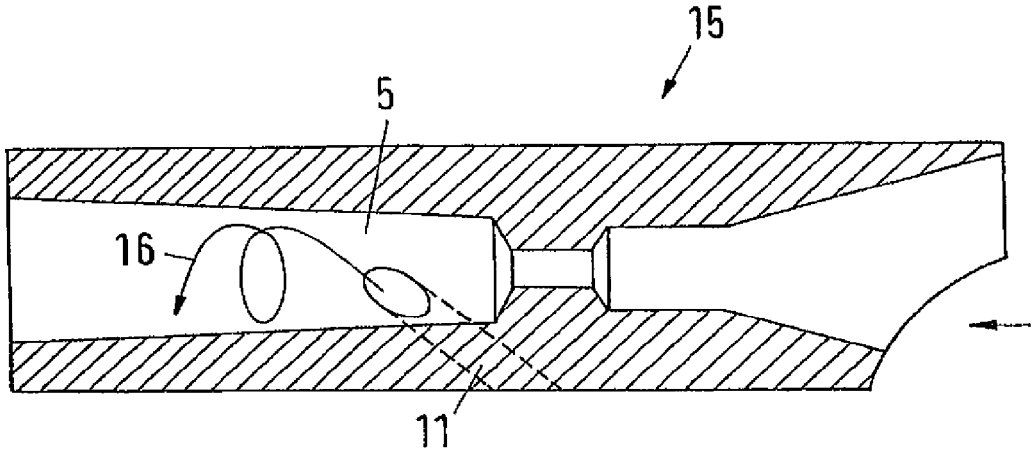
FIG. 3 shows an alternate twist application component according to an exemplary embodiment of the present invention.

FIG. 3 shows another exemplary embodiment of a twist application component 15 according to the present invention. Twist application component 15 operates in accordance with the single-nozzle false twist process and does not utilize a roving yarn formation element. The twist application component 15 exhibits only one swirl chamber 5, in which an air flow 16 (swirl flow) is created by means of one or more nozzle openings 11. This air flow 16 subjects the drafter sliver 3 at least partially to a true twist in the swirl chamber 5.

Figure 3A:
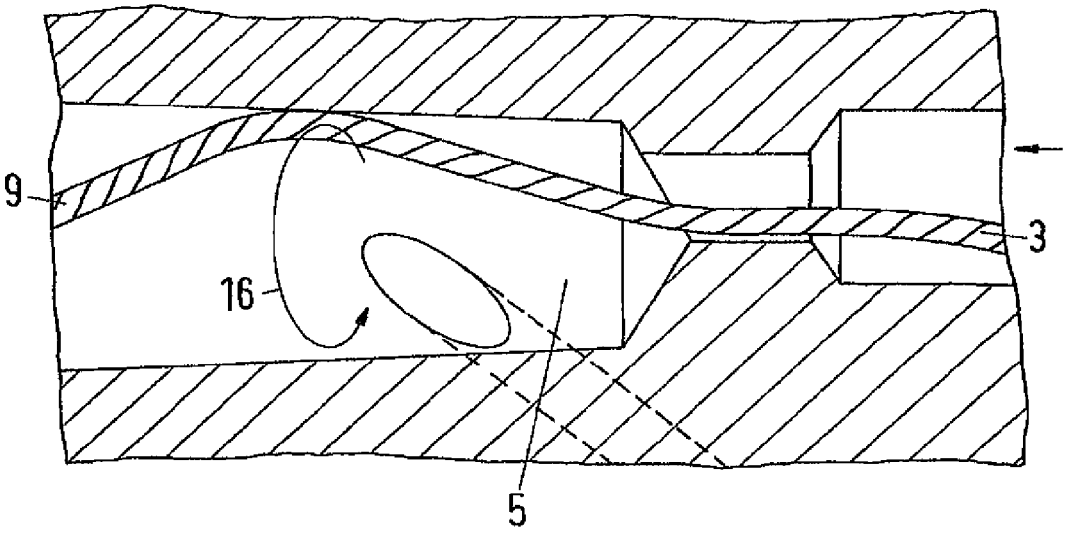
FIG. 3A shows the application of a true twist inside the swirl chamber of the twist application component shown in FIG. 3.

FIG. 3A illustrates the true twist application. Inside swirl chamber 5, a rotation is applied to the drafter sliver by the air flow 16. As a result, at least a part of the fibers of the drafter sliver are rotated or twisted so that the stubbing 9 is formed.

FIG. 3B shows a variation of the twist application component shown in FIG. 3A. The twist application component 17 exhibit two swirl chambers 5, neither of which include a roving yarn formation element. The true twist is applied by one, or in this case two, air flows 16.1 and 16.2. At least a part of the fibers of the drafter sliver 3 receive a true twist. The roving yarn 9 may be drawn off and wound up by a device (not represented). Preferably, the twist application component 17 includes several nozzle holes 11. The nozzle holes 11 serve to produce the air flows 16.1 and 16.2. The nozzle holes are aligned in such a way that the emerging air jets jointly and together create the air flow 16.1 and 16.2 respectively. For this purpose, the inlet angles of the nozzle holes 11 are preferably the same inside the individual swirl chamber 5. The air flows 16.1 and 16.2 are also directed in the same way so that the two air flows 16.1 and 16.2, despite being in separate swirl chambers, have the same direction of rotation.

Figure 3C:
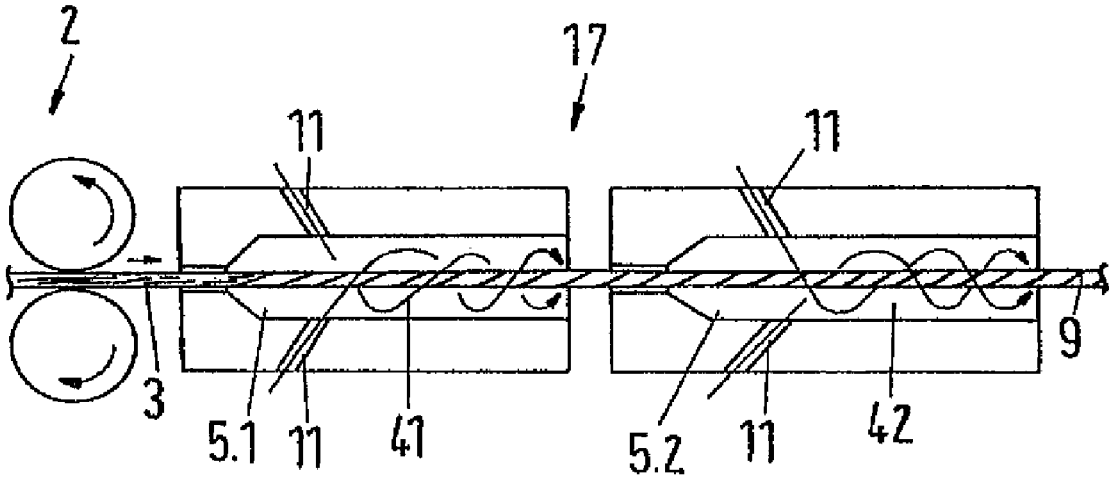
FIG. 3C shows a variant of the twist application component.

FIG. 3C shows a variation of the twist application component shown in FIG. 3B. The twist application component 40 differs from the device depicted in FIG. 3B because the air flows 41 and 42 in the swirl chambers 5.1 and 5.2 are not in the same direction but are in opposite directions. In other words, the air flow 41 is right-rotating and the air flow 42 is left-rotating. As a result, the drafter sliver 3 is subjected to a twist according to a false twist process.

The individual nozzle holes may be arranged rotationally symmetrically to one another in certain exemplary embodiments of the present invention.

A twist application component according to the present invention may also exhibit one or more twist stops. Twist stops can exhibit different forms. A twist stop can be formed, for example, as an edge, a pin, a toroidal surface, a cone, or in the form of several deflecting surfaces.

Figure 4:
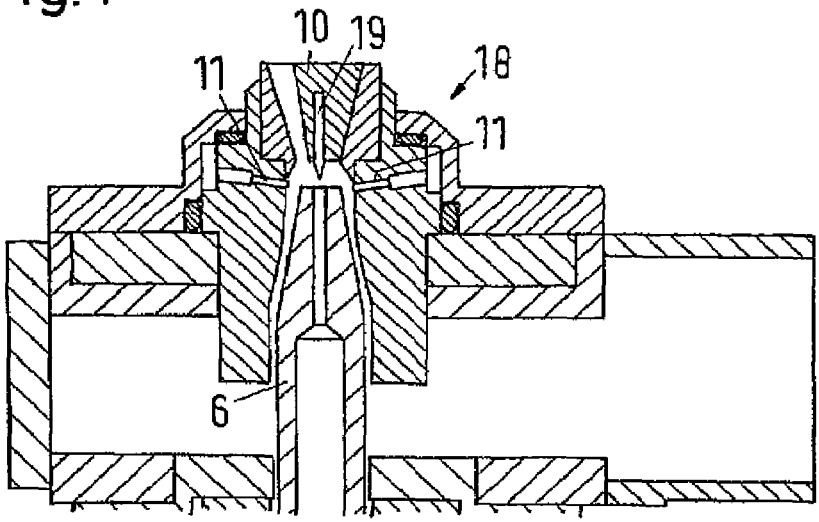
FIG. 4 shows a twist application component with a twist stop in the form of a pin.

FIG. 4 shows a twist application component 18 with a twist stop in the form of a pin 19. The remaining elements in FIG. 4 correspond largely to the embodiments already described and also exhibit accordingly the same reference numerals. The pin 19 in FIG. 4 serves both as a twist jamming element as well as a false yarn core. Twist stops serve to prevent a rotation in the drafter sliver from being propagated further rearwards. This prevents any possible false twist from occurring. The use of twist stops for the devices and methods according to the present invention is not absolutely necessary, but is recommendable. In particular, the true twist application by an air flow is improved. A twist stop is not absolutely necessary in exemplary embodiments of the present invention in which the twist application takes place according to a false twist process.

Figure 4A:
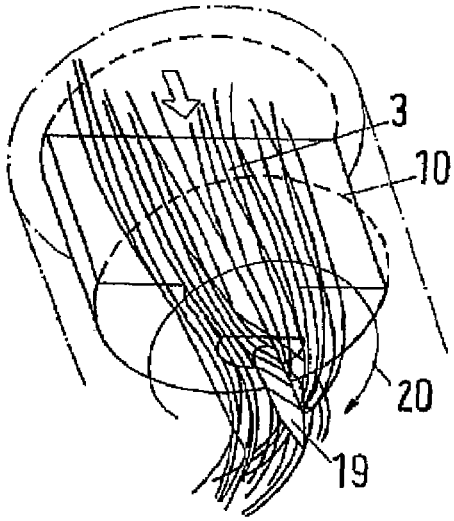
FIG. 4A shows how a pin prevents the twist from propagating further upstream of the fiber guide element.
Figure 4B:
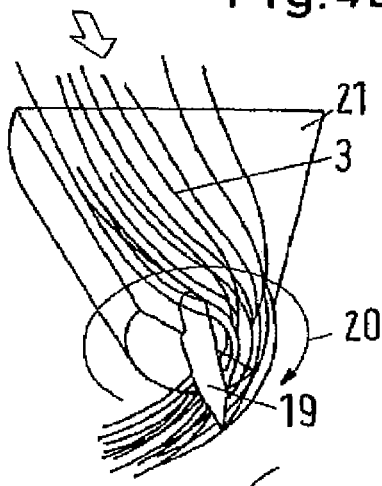
FIG. 4B shows how a pin in combination with a toroidal surface prevents the twist incurred by the air flow from propagating further upstream of the fiber guide element.

As is shown in FIGS. 4A and 4B, a pin 19 prevents the twist incurred by the air flow from propagating further upstream of the fiber guide element. This can be seen particularly well in FIGS. 4A, 4B, and 4C. The air flow 20 around the mouth of the roving yarn formation element (not shown) creates a rotation or a twist inside the drafter sliver 3. Due to the presence of the pin 19 as a twist stop, the rotation of the fibers lying on the fiber guide element 10 and 21 is prevented. This is illustrated by the parallel non-twisted fibers on the fiber guide elements 10 and 21 in FIGS. 4A and 4B.

Figure 4C:
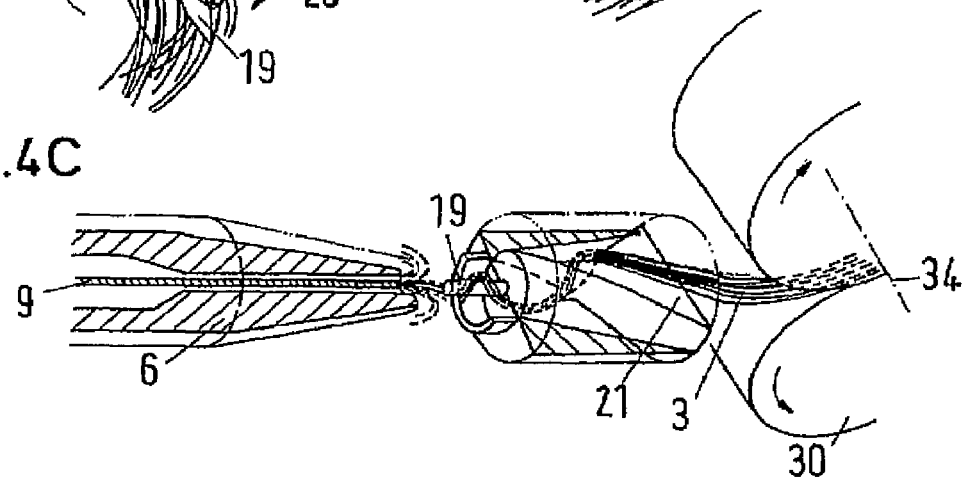
FIG. 4C provides an alternative view of how a pin in combination with a toroidal surface prevents the twist incurred by the air flow from propagating further upstream of the fiber guide element.

A toroidal fiber guide surface 21 can also serve as a twist stop. FIG. 4B shows a toroidal fiber guide surface 21 that additionally exhibits a pin 19. As a result, the twist stop function is particularly effective. A toroidal fiber guide surface 21 with pin is also represented in FIG. 4C. The elements in FIG. 4C correspond largely to the elements in FIG. 4B, with the difference that the pin 19 in FIG. 4C is truncated.

Figure 5:
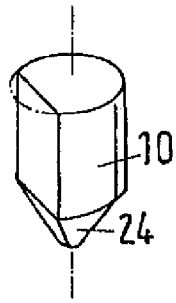
FIG. 5 shows a fiber guide element with a twist stop cone.

FIG. 5 shows a fiber guide element 10 with what is referred to as a twist stop cone 24. The twist stop cone 24 performs the function of the twist stop. The mode of operation is the same as with the pin 19 depicted in FIGS. 4A, 4B, and 4C. The twist stop cone also serves as a false yarn core. The fibers or drafter sliver lie in spiral fashion around the false yarn core, resulting in the prevention of the twist from being propagated further upstream.

Figure 6:
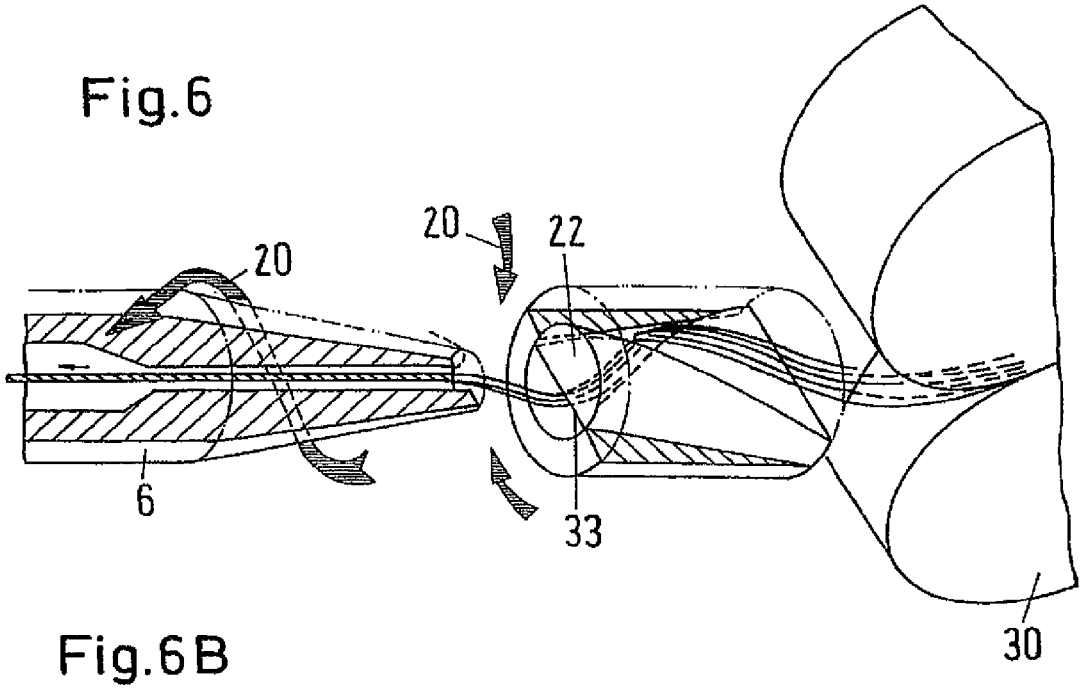
FIG. 6 shows a twist stop consisting of a toroidal surface without a pin.
Figure 6B:
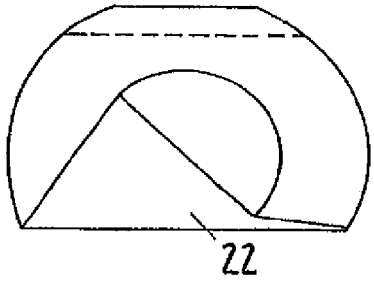
FIG. 6B shows an alternative view of a twist stop consisting of a toroidal surface without a pin.
Figure 6A:
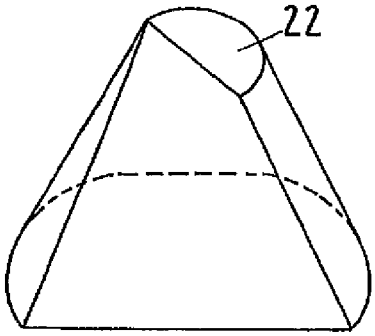
FIG. 6A shows an alternative view of a twist stop consisting of a toroidal surface without a pin.

FIG. 6 depicts a twist stop consisting of one toroidal fiber guide element 22 without a pin. A toroidal fiber guide surface is sufficient as a twist stop. The additional use of a pin is not absolutely necessary. Different views of a toroidal fiber guide element 22 without pin are shown in FIGS. 6A and 6B.

Those of ordinary skill in the art should appreciate, using the teachings disclosed herein, that it is also possible for only an edge 33 to serve as a twist stop. The edge 33 does not necessarily have to be accompanied by a toroidal fiber guide surface to serve as a twist stop element.

Figure 7:
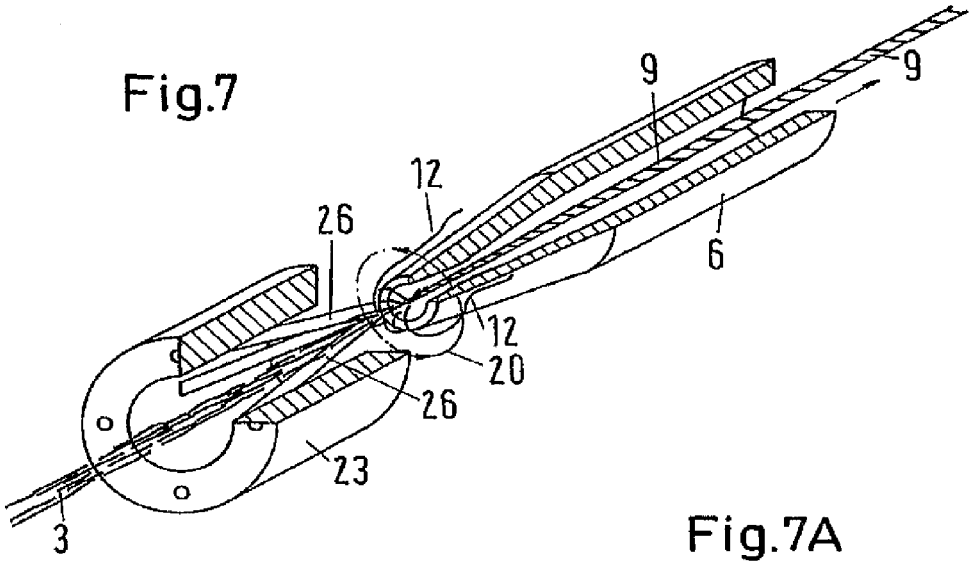
FIG. 7 shows a fiber guide element with deflection surfaces acting as a twist stop.

FIG. 7 shows additional twist stops which may be used according to exemplary embodiments of the present invention. FIG. 7 depicts a fiber guide element 23 with several deflection surfaces. These deflection surfaces 26 have the function, in addition to deflecting the drafter sliver 3, to also act as a twist stop. It can be readily seen in FIG. 7 how the deflection surfaces 26 perform the twist stop function. The drafter sliver is drawn in the non-twisted state in the direction of the roving yarn formation element 6. At the mouth of the roving yarn formation element 6 the free fiber ends 12 are rotated by the air flow 20 of the swirl chamber by a true twist application. The rotation of the free fiber ends 12 causes a torsion moment, which tries to propagate against the draw-off direction (arrow) of the roving yarn in the drafter sliver 3. Due to the presence of the deflection surfaces 26, this torsion moment is stopped. No rotation propagates into the drafter sliver 3.

Figure 7A:
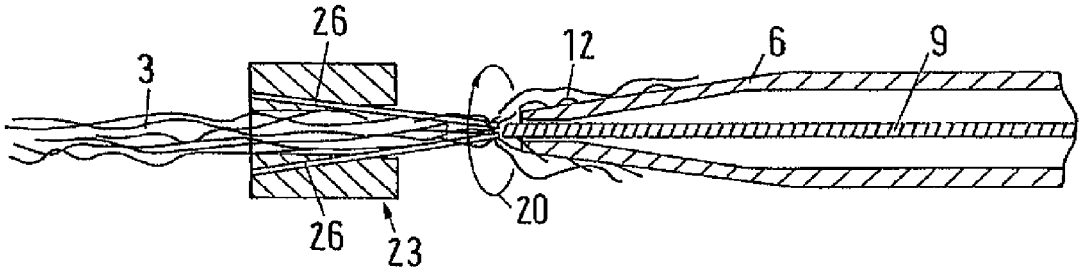
FIG. 7A shows side view of a fiber guide element with deflection surfaces acting as a twist stop.

Without the deflection surfaces 26 acting as a twist stop, the rotation would propagate into the drafter sliver 3 and a false twist would occur. This false twist, under certain circumstances, would prevent a true twist of the drafter sliver. A further representation of the circumstances just explained can be seen in FIG. 7A. FIG. 7A illustrates how the drafter sliver 3 remains untwisted thanks to the deflection surfaces 26.

Figure 8A:
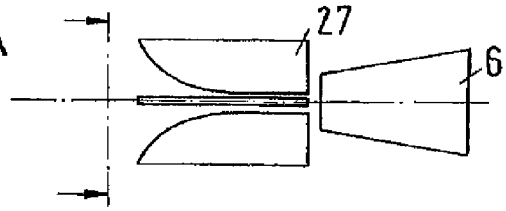
FIG. 8A shows alternate deflection surfaces acting as a twist stop.
Figure 8C:
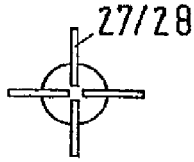
FIG. 8C shows an end view of the deflection surfaces shown in FIGS. 8A and 8B.
Figure 8B:
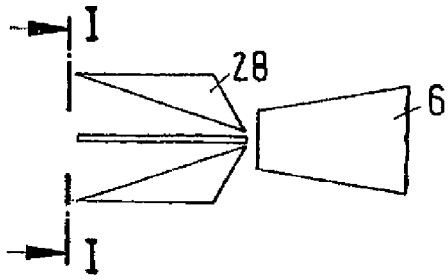
FIG. 8B shows alternate deflection surfaces acting as a twist stop.

FIGS. 8A and 8B show deflection surfaces 27 and 28 that can also act as twist stops. FIG. 8C shows an end view of the deflection surfaces 27 and 28 respectively in the draw-off direction of the drafter sliver. The deflection surfaces 26, 27 and 28 represent only some of the possible forms deflection surfaces that can act as a twist stop. Using the teachings disclosed herein, other deflection surfaces known in the art may also be used.

Figure 9:
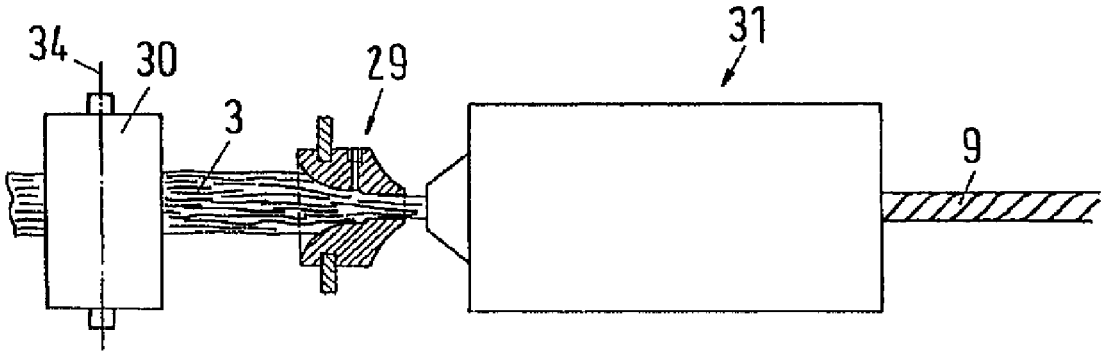
FIG. 9 shows a funnel used to restrict the width of a fiber assembly as the fiber assembly is led to a twist application component.

A slubbing machine according to an exemplary embodiment of the present invention may also include a funnel or an aerodynamic or mechanical condenser, which has the function of restricting the width of the fiber assembly as it is led to a twist application component. FIG. 9 shows a funnel 29 used to restrict a drafter sliver 3 in its width the drafter sliver 3 is led to a twist application component 31, Such a funnel 29 or other condenser can be arranged downstream of a pair of delivery rollers 30. The pair of delivery rollers 30 is shown in a plan view. The reference number 34 indicates the nip line of the pair of delivery rollers 30.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

LEGEND

1 Spinning position of a slubbing machine
2 Drafting device
3 Drafter sliver
4 Twist application component
5 Swirl chamber
6 Roving yarn formation element (spindle)
7 Winding device
8 Pair of delivery rollers
9 Roving yarn
10 Fiber guide element
11 Nozzle holes or nozzles
12 Free fiber ends
13 Intake aperture
14 Core
15 Twist application component without roving yarn formation element
16, 16.1 Air flow
17 Twist application component with two swirl chambers
18 Twist application component with twist stop
19 Pin
20 Air flow
21 Toroidal fiber guide element with pin
22 Toroidal fiber guide element without pin
23 Fiber guide element with several deflection surfaces
24 Twist stop cone
25 Fiber guide element
26, 27, 28 Deflection surfaces with twist stop function
29 Funnel
30 Pair of delivery rollers
31 Twist application component
32 Air flow
33 Edge
34 Nip line
35 Drawing-frame-slubbing machine combination
36 Drawing frame
37 Drafting unit
38 Fiber Assembly
40 Twist application component
41 Right-rotating air flow
42 Left-rotating air flow

The invention claimed is:

1. A drawing frame-slubbing machine combination for the manufacture of a roving yarn from a plurality of fiber assemblies, comprising:

a first section comprising a drawing frame configured to produce a sliver from the plurality of fiber assemblies; and a second section arranged downstream of said first section, said second section comprising a spinning position, said spinning position comprising a twist application component comprising a swirl chamber;

wherein said sliver is at least partially subjected to a true twist inside said swirl chamber by an air flow, said twist being a protective twist the result of which the roving yarn remains capable of being drafted.

2. The drawing frame-slubbing machine combination of claim 1, wherein the drawing frame is regulated.

3. The drawing frame-slubbing machine combination of claim 1, wherein the swirl chamber further comprises a roving yarn formation element.

4. The drawing frame-slubbing machine combination of claim 3, wherein the roving yarn formation element is a spindle.

5. The drawing frame-slubbing machine combination of claim 1, wherein the twist application component further comprises at least one twist stop.

6. The drawing frame-slubbing machine combination of claim 5, wherein the twist stop is an edge.

7. The drawing frame-slubbing machine combination of claim 5, wherein the twist stop is a pin.

8. The drawing frame-slubbing machine combination of claim 5, wherein the twist stop is a toroidal surface.

9. The drawing frame-slubbing machine combination of claim 5, wherein the twist stop is a deflection surface.

10. The drawing frame-slubbing machine combination of claim 1, wherein the twist application component comprises a plurality of nozzles for the production of air jets, the nozzles being arranged so that said air jets form a single, unidirectional airflow.

11. The drawing frame-slubbing machine combination of claim 10, wherein the plurality of nozzles are arranged rotationally symmetrically.

12. The drawing frame-slubbing machine combination of claim 1, wherein the twist application component comprises a first swirl chamber and a second swirl chamber, the first and second swirl chambers comprising a plurality of nozzles for the production of air jets;

the plurality of nozzles Located in said first swirl chamber are arranged so that said air jets form a first unidirectional airflow; and the plurality of nozzles located in said second swirl chamber are arranged so that said air jets form a second unidirectional airflow;

said first unidirectional airflow rotates in a direction opposite to said second unidirectional airflow.

13. The drawing frame-slubbing machine combination of claim 1, wherein said spinning position further comprises a funnel upstream of the twist application component and the sliver has a width, said funnel configured to restrict the width of the sliver as it is led to the twist application component.

14. The drawing frame-slubbing machine combination of claim 1, wherein the twist application component has an inlet the spinning position has a nip line, and the sliver has a length, said inlet of said twist application component being at a distance from said nip line not greater than the length of said sliver.

15. The drawing frame-slubbing machine combination of claim 3, wherein the roving yarn formation element has an inlet, the spinning position has a nip line and the drafter sliver has a length, said inlet of said roving yarn formation element being at a distance from the nip line not greater than the length of the sliver.

16. The drawing frame-slubbing machine combination of claim 1, wherein the spinning position further comprises a winding device located downstream of the twist application component.

17. A method of manufacturing a roving yarn from a plurality of fiber assemblies, the method comprising:

providing a drawing frame-slubbing machine combination comprising a first section comprising a drawing frame and a second section arranged downstream from said first section, said second section comprising a spinning position having a twist application component comprising a swirl chamber;

doubling and stretching said fiber assembly in said drawing frame of said first section of said drawing frame-slubbing machine combination to produce a drafter sliver;

stretching said drafter sliver to produce a drafted sliver;

at least partially subjecting said drafted sliver to a true twist application in said swirl chamber by an air flow, said twist application being a protective twist the result of which the roving yarn remains capable of being drafted.

18. The method of manufacturing a roving yarn of claim 17, wherein said air flow is produced by a plurality of nozzles that produce air jets, said plurality of nozzles being arranged so that said air jets form a single, unidirectional airflow.

19. The drawing frame-slubbing machine combination of claim 1, wherein said second section comprises a drafting device arranged upstream of said twist application component, said drafting device configured to produce a drafted sliver from said sliver.

20. The drawing frame-slubbing machine combination of claim 16, wherein said winding device comprises a cross-winder, a precision cross-winder, a random cross-winder, a step cross-winder, or a parallel winder.

* * * * *

UNITED STATES PATENT AND TRADEMARK OFFICE

CERTIFICATE OF CORRECTION

PATENT NO. : 7,647,760 B2
APPLICATION NO. : 10/571413
DATED : January 19, 2010
INVENTOR(S) : Griesshammer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 674 days.

Signed and Sealed this

Sixteenth Day of November, 2010

David J. Kappos

David J. Kappos
*Director of the United States Patent and Trademark Office*